US009333389B2

(12) United States Patent
Lin

(10) Patent No.: US 9,333,389 B2
(45) Date of Patent: May 10, 2016

(54) BICYCLE TRAINING STAND

(71) Applicant: BH Asia Ltd., Taichung (TW)

(72) Inventor: Fu-Hai Lin, Taichung (TW)

(73) Assignee: BH Asia Ltd., Taichung (TW)

( * ) Notice: Subject to any disclaimer, the term of this patent is extended or adjusted under 35 U.S.C. 154(b) by 6 days.

(21) Appl. No.: 14/274,360

(22) Filed: May 9, 2014

(65) Prior Publication Data

US 2015/0151157 A1 Jun. 4, 2015

(30) Foreign Application Priority Data

Dec. 4, 2013 (TW) ..... 102222809 U

(51) Int. Cl.
*A63B 22/06* (2006.01)
*A63B 69/16* (2006.01)

(52) U.S. Cl.
CPC ..... *A63B 22/0605* (2013.01); *A63B 69/16* (2013.01); *A63B 2069/165* (2013.01)

(58) Field of Classification Search
CPC ..... A63B 22/0605; A63B 23/0476; A63B 69/16; A63B 2069/161; A63B 2069/164; A63B 2069/165; B61H 1/00; B61H 3/00; B62H 2700/00
USPC ..... 482/51, 57–65; 248/220.21, 220.22, 248/221.11, 222.11, 222.51, 222.52; 211/5, 211/19–24; 280/29, 200
See application file for complete search history.

(56) References Cited

U.S. PATENT DOCUMENTS

| | | | | |
|---|---|---|---|---|
| 6,019,708 | A * | 2/2000 | Kaminski et al. | 482/57 |
| 6,203,472 | B1 * | 3/2001 | McCaffrey et al. | 482/61 |
| 6,702,721 | B2 * | 3/2004 | Schroeder | 482/61 |
| 6,736,761 | B2 * | 5/2004 | Huang | 482/57 |
| 7,758,474 | B1 * | 7/2010 | Pedrini | 482/61 |
| 7,998,033 | B1 * | 8/2011 | Schroeder | 482/61 |
| 2003/0051952 | A1 * | 3/2003 | Mercante | 188/267 |
| 2006/0144804 | A1 * | 7/2006 | Chiu | 211/20 |
| 2006/0234839 | A1 * | 10/2006 | Peterson et al. | 482/61 |
| 2007/0123397 | A1 * | 5/2007 | Schroeder | 482/61 |
| 2007/0142184 | A1 * | 6/2007 | Schroeder | 482/61 |
| 2014/0094348 | A1 * | 4/2014 | Bass et al. | 482/61 |

* cited by examiner

*Primary Examiner* — Stephen Crow
*Assistant Examiner* — Gregory Winter
(74) *Attorney, Agent, or Firm* — Tracy M. Heims; Apex Juris, pllc

(57) ABSTRACT

A bicycle training stand includes a frame, a first clamping unit, and a second clamping unit. An axle of a bicycle wheel is clamped between the first and the second clamping units. The first clamping unit includes an abutting member and an operation member, wherein the abutting member is fitted in an axle bore of the frame, and can be moved in an axial direction of the axle bore. The abutting member has an abutting end contacting the axle of the bicycle wheel. The operation member is pivotally connected to the frame, and can be moved between a first position and a second position. When the operation member is at the first position, the contacting portion presses the abutting member; when the operation member is at the second position, the contacting portion has no contact with the abutting member.

6 Claims, 7 Drawing Sheets

BICYCLE TRAINING STAND

BACKGROUND OF THE INVENTION

1. Technical Field

The present invention relates generally to cycling, and more particularly to a bicycle training stand.

2. Description of Related Art

With a bicycle installed on, a bicycle training stand provides different levels of resistance to the rear wheel to simulate outdoor conditions. In this way, a bicycle rider can train indoors with preferred difficulties. A conventional training stand disclosed in Taiwan patent NO. M293048 includes a supporting frame, a resistance provider, and two threaded rods. The resistance provider is provided at a bottom of the supporting frame, and the threaded rods are provided at two opposite sides on a top of the supporting frame. Each threaded rod has a clamping member to clamp two ends of an axle of a bicycle wheel to firmly fix a bicycle on the training stand. While operating, the bicycle wheel and the resistance provider contact each other, and the resistance therebetween is controlled by the resistance provider.

To engage the bicycle wheel with the conventional bicycle training stand, a user has to adjust the position of each clamping member by screwing the threaded rods. However, screwing the threaded rods is usually a bothersome process, which makes the installation not efficient enough.

BRIEF SUMMARY OF THE INVENTION

In view of the above, the primary objective of the present invention is to provide a bicycle training stand, of which the clamp spacing for engaging the axle of a bicycle wheel can be adjusted easily and quickly without affecting the firmness of the engagement.

The bicycle training stand provided in the present invention engages with an axle of a bicycle wheel, and it includes a frame, a first clamping unit, and a second clamping unit. The first and the second clamping units are respectively provided at two ends of the frame, and the axle of the bicycle wheel is clamped between the first and the second clamping units. The bicycle training stand is characterized in that at least one of the two ends of the frame is provided with an axle bore and a perforation communicated with the axle bore, and the first clamping unit comprises an abutting member and an operation member. The abutting member is fitted in the axle bore of the frame, where in the abutting member is movable in an axial direction of the axle bore, and has an abutting end to contact the axle of the bicycle wheel. The operation member is pivotally provided on the frame, wherein the operation member can be moved between a first position and a second position, and has a contacting portion which goes through the perforation; when the operation member is at the first position, the contacting portion presses the abutting member to confine a position of the abutting member; when the operation member is at the second position, the contacting portion has no contact with the abutting member.

The abutting member and the operation member of the first clamping unit form a quick assembly and disassembly mechanism. By moving the operation member between the first and the second position, the abutting member either is firmly engaged with the frame or can be moved freely. Whereby, the axle of a bicycle wheel can be installed on the training stand quickly. Since the installation takes less time, and the process is simply and convenient, the user would be willingly to use the training stand more frequently.

BRIEF DESCRIPTION OF THE SEVERAL VIEWS OF THE DRAWINGS

The present invention will be best understood by referring to the following detailed description of some illustrative embodiments in conjunction with the accompanying drawings, in which.

DETAILED DESCRIPTION OF THE INVENTION

As shown in FIG. 1 to FIG. 6, the bicycle training stand 100 of the preferred embodiment of the present invention includes a frame 10, a first clamping unit 20, and a second clamping unit 30.

Figure 1:
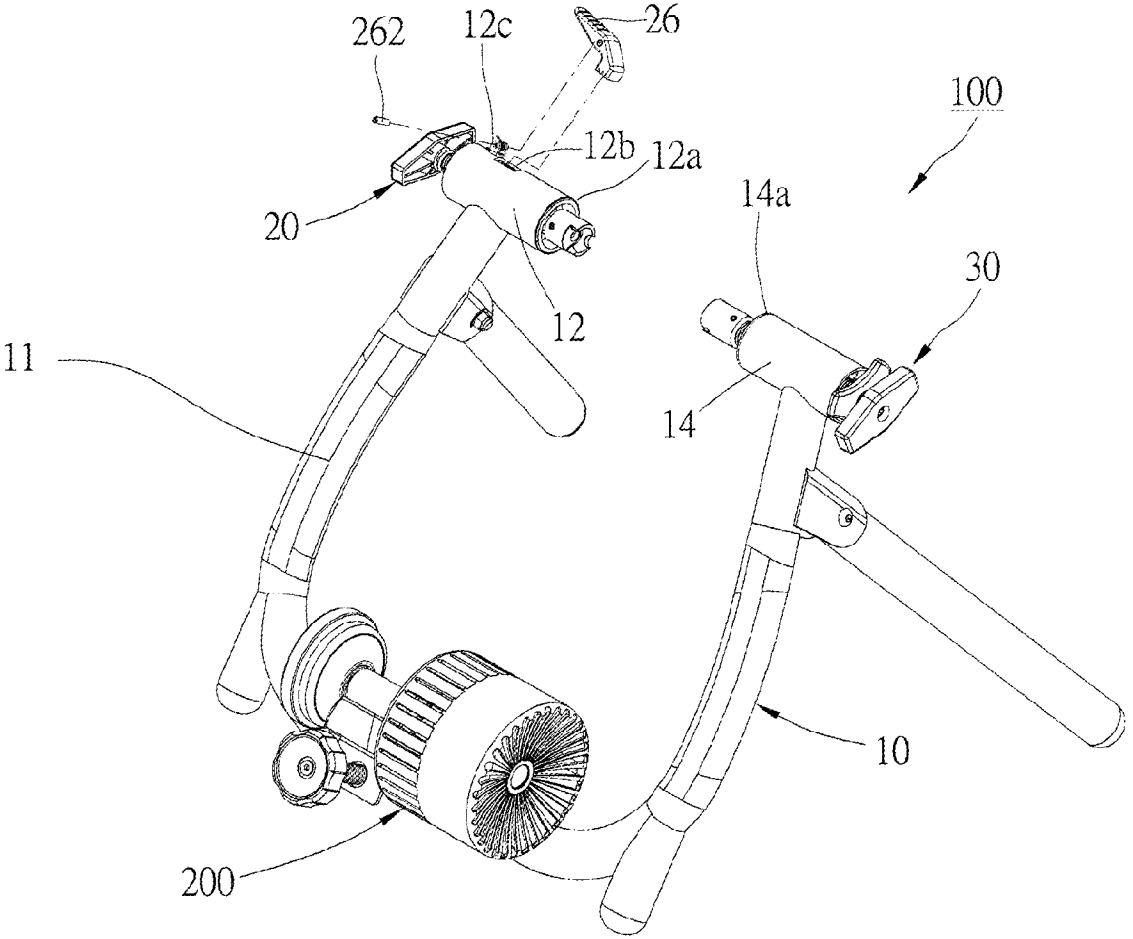
FIG. 1 is a perspective view of the bicycle training stand of a preferred embodiment of the present invention.
Figure 7:
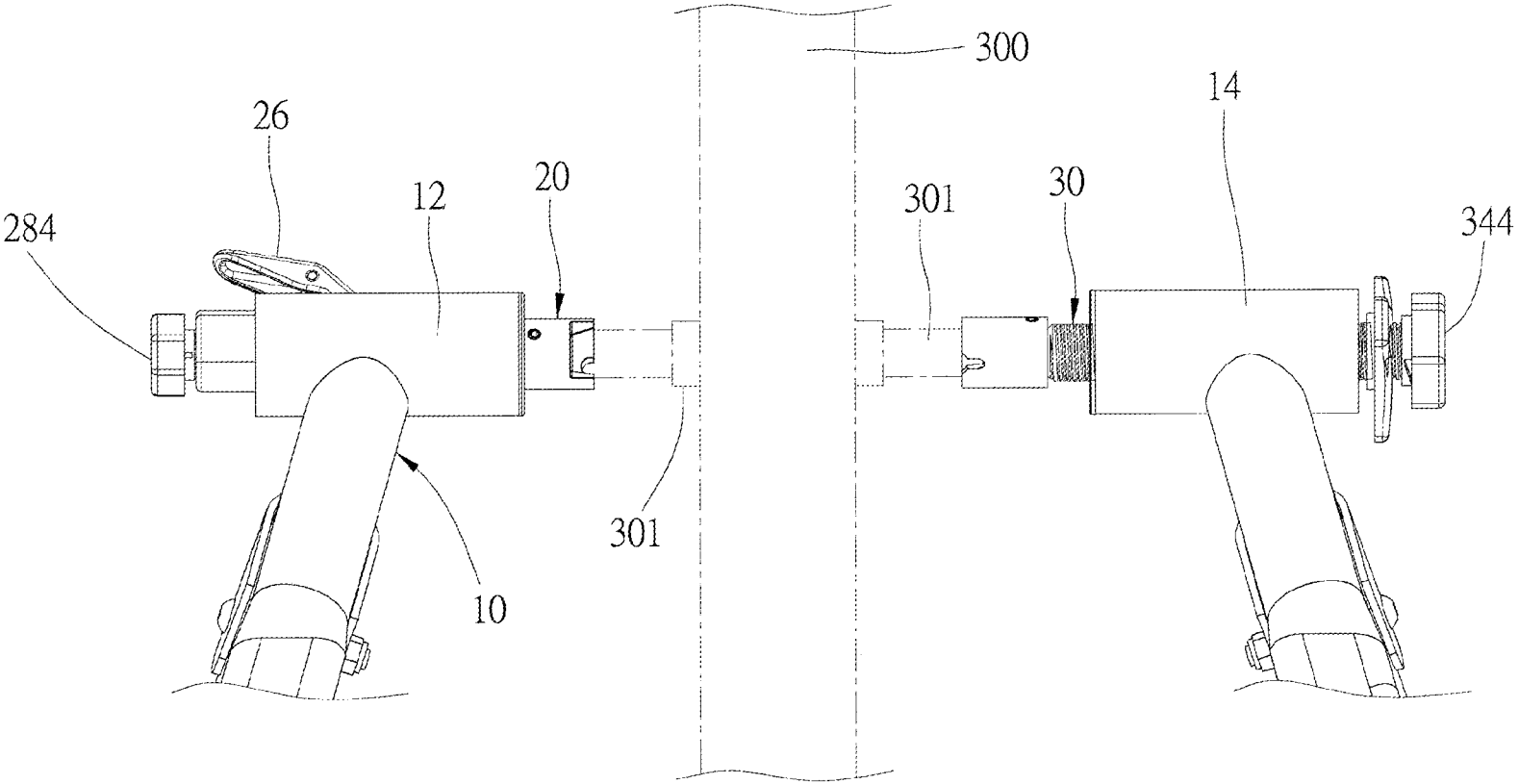
FIG. 7 is a schematic diagram showing the relation between the bicycle training stand of the preferred embodiment of the present invention and the axle of a bicycle wheel.

A damping device 200 is provided on the frame 10 of the bicycle training stand 100. As shown in FIG. 1 and FIG. 7, an axle 301 of a bicycle wheel 300 is placed between the first clamping unit 20 and the second clamping unit 30, and is clamped by them from both sides. The bicycle wheel 300 contacts the damping device 200, and therefore while a bicycle rider is driving the bicycle wheel 300 to rotate, the damping device 200 provides different levels of resistance to the bicycle wheel 300 to simulate outdoor conditions.

The frame 10 has a U-shaped tube 11, a first shaft tube 12, and a second shaft tube 14, wherein the first shaft tube 12 and the second shaft tube 14 are respectively provided at opposite ends of the U-shaped tube 11. The first shaft tube 12 has an axle bore 12*a*, and the second shaft tube 14 has an axle bore 14*a* as well. The first shaft tube 12 is further provided with a perforation 12*b* and a convex lug 12*c* thereon, wherein the perforation 12*b* is communicated with the axle bore 12*a*. The convex lug 12*c* is provided on an outer surface of the first shaft tube 12, and is near the perforation 12*b*. The first clamping unit 20 is provided in the axle bore 12*a*, and the second clamping unit 30 is provided in the axle bore 14*a*.

Figure 2:
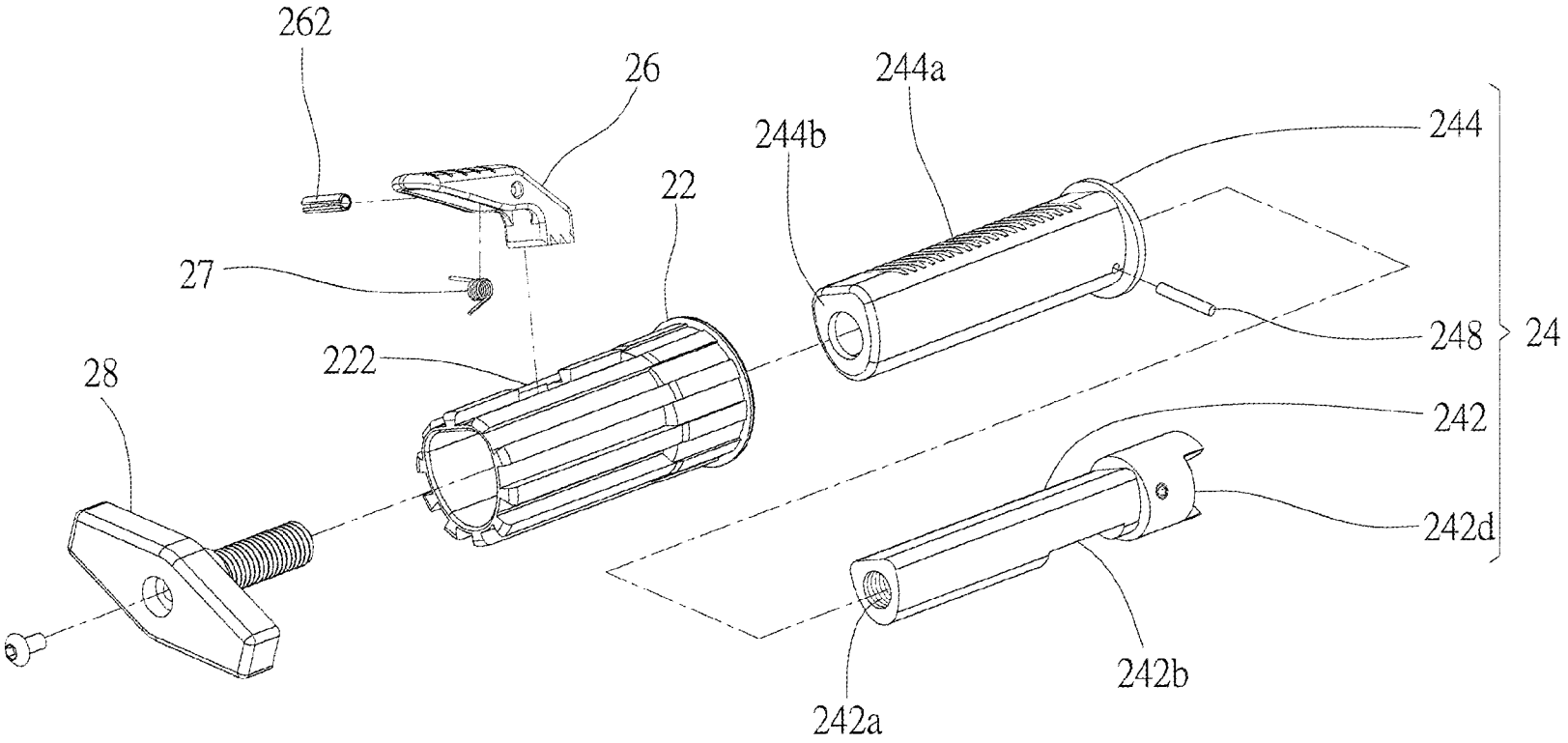
FIG. 2 is an exploded view of the first clamping unit of the preferred embodiment of the present invention.

As shown in FIG. 1 and FIG. 2, the first clamping unit 20 includes a bushing 22, an abutting member 24, an operation member 26, an adjusting member 28, and a biasing member, which is a torsion spring 27 in the preferred embodiment. The bushing 22 is made of plastic, and is plugged in the axle bore 12*a*. The bushing 22 is provided with a through hole 222 thereon, wherein the through hole 222 and the perforation 12*b* are aligned and communicated with each other. The abutting member 24 is movably received in the bushing 22. The purpose of providing the plastic bushing 22 is to avoid abrasion on the abutting member 24 and the first shaft tube 12.

Figure 3:
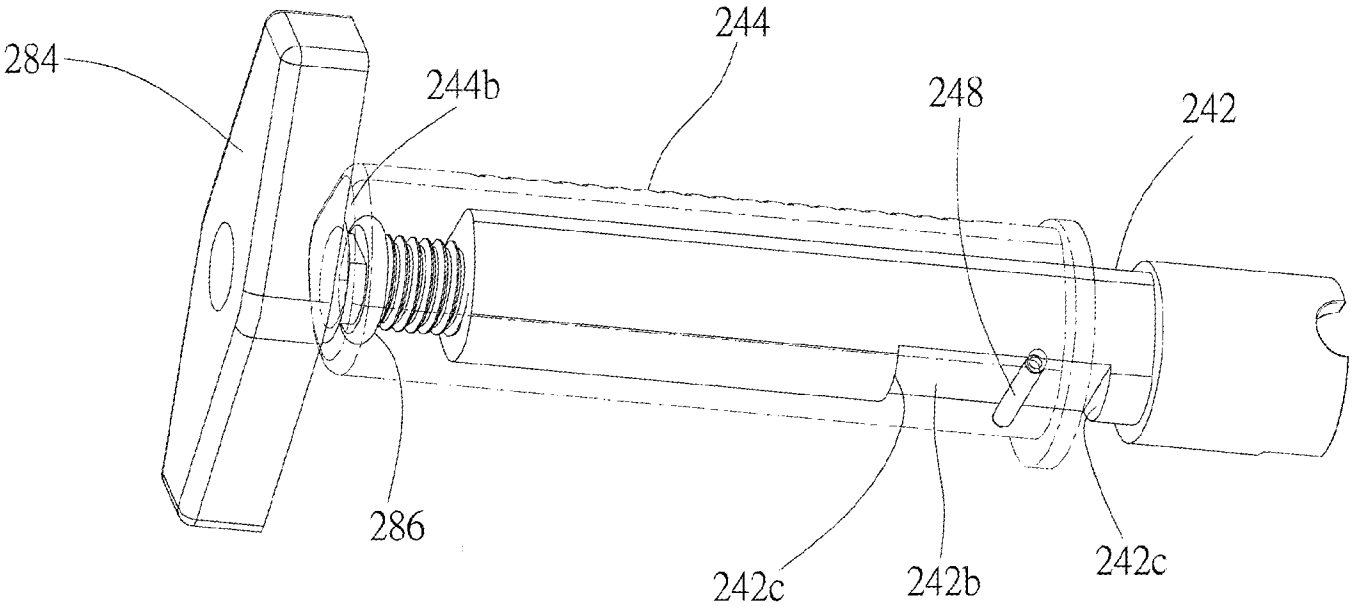
FIG. 3 is a partial perspective view of the first clamping unit of the preferred embodiment of the present invention, showing the relation between the pin and the abutting shaft.

The abutting member 24 includes an abutting shaft 242, a sleeve 244, and a pin 248, wherein the sleeve 244 is open at opposite ends thereof, and an inner recess ring 244*b* is further formed at an end of the sleeve 244, which extends inwardly from the end of the sleeve 244 to form an opening at a center thereof. The sleeve 244 is provided with a rack 244*a* on an outer surface thereof. The abutting shaft 242 is fitted into the sleeve 244. The abutting shaft 242 has two ends, wherein one of the two ends is provided with an abutting end 242*d*, and the other end has a threaded hole 242*a*. As shown in FIG. 3, the abutting shaft 242 has a recess 242*b* on an outer surface thereof, wherein the recess 242*b* has two opposite abutting faces 242*c*. The pin 248 is transversely inserted into the sleeve 244 to cross the recess 242*b*. A movable range of the abutting shaft 242 is restricted by an abutment relation between the pin 248 and the abutting faces 242*c*. In other words, no matter in which direction the abutting shaft 242 is moved, the pin 248 eventually abuts against one of the abutting faces 242*c*, and therefore the abutting shaft 242 is stopped from being further moved.

Figure 4:
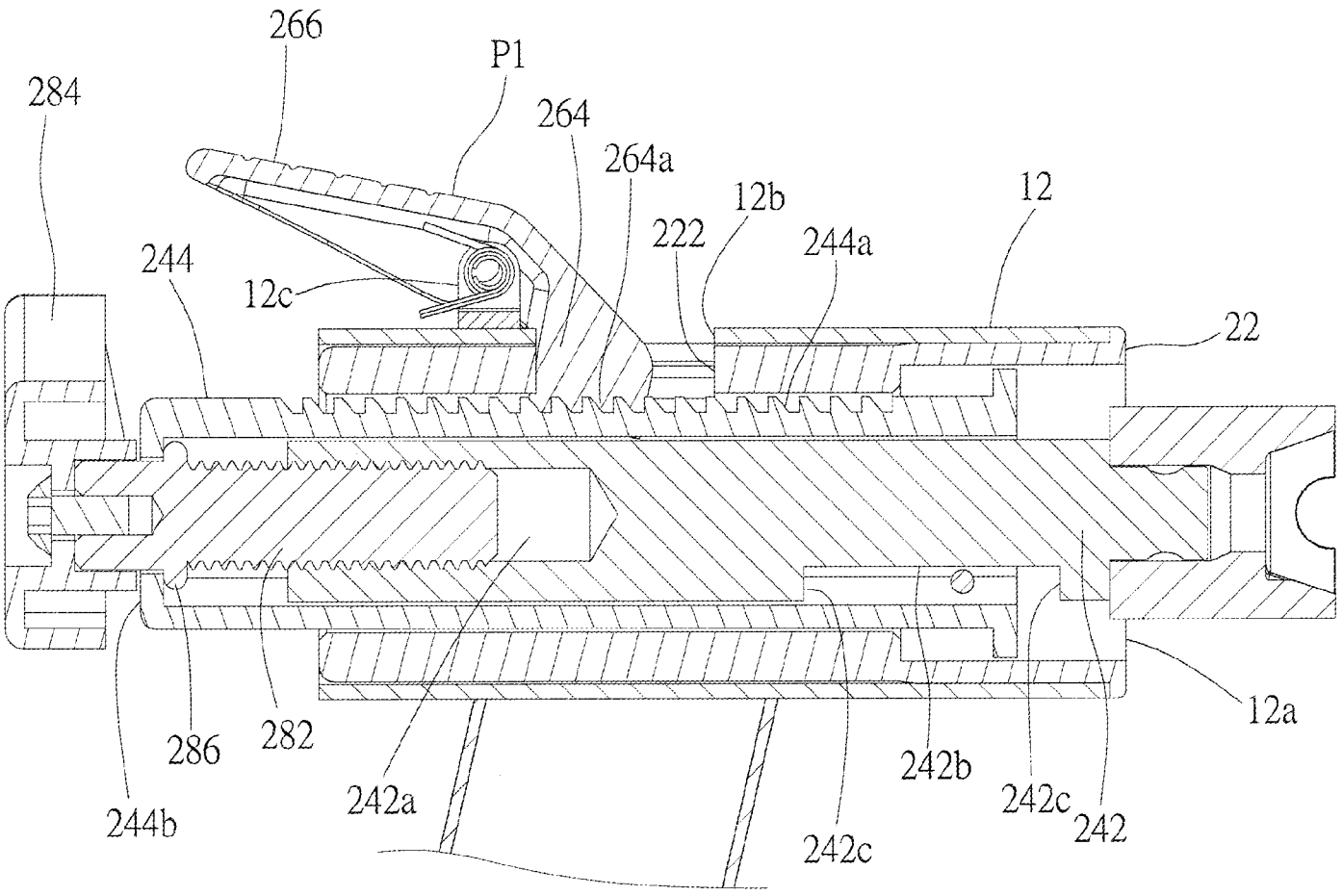
FIG. 4 is a sectional view of the first clamping unit of the preferred embodiment of the present invention, showing the operation member at the first position.

As shown in FIG. 4, the adjusting member 28 has a threaded rod 282 and a head 284. An end of the threaded rod 282 is screwed into the threaded hole 242*a* of the abutting shaft 242, and an opposite end thereof extends out of the sleeve 244 to be connected to the head 284. The threaded rod 282 further has a protrusion 286 near the head 284. A position of the adjusting member 28 can be confined since the protrusion 286 and the head 284 of the threaded rod 282 are respectively at opposite sides of the inner recess ring 244*b* of the sleeve 244. Still, the adjusting member 28 can be rotated at its confined position.

Figure 5:
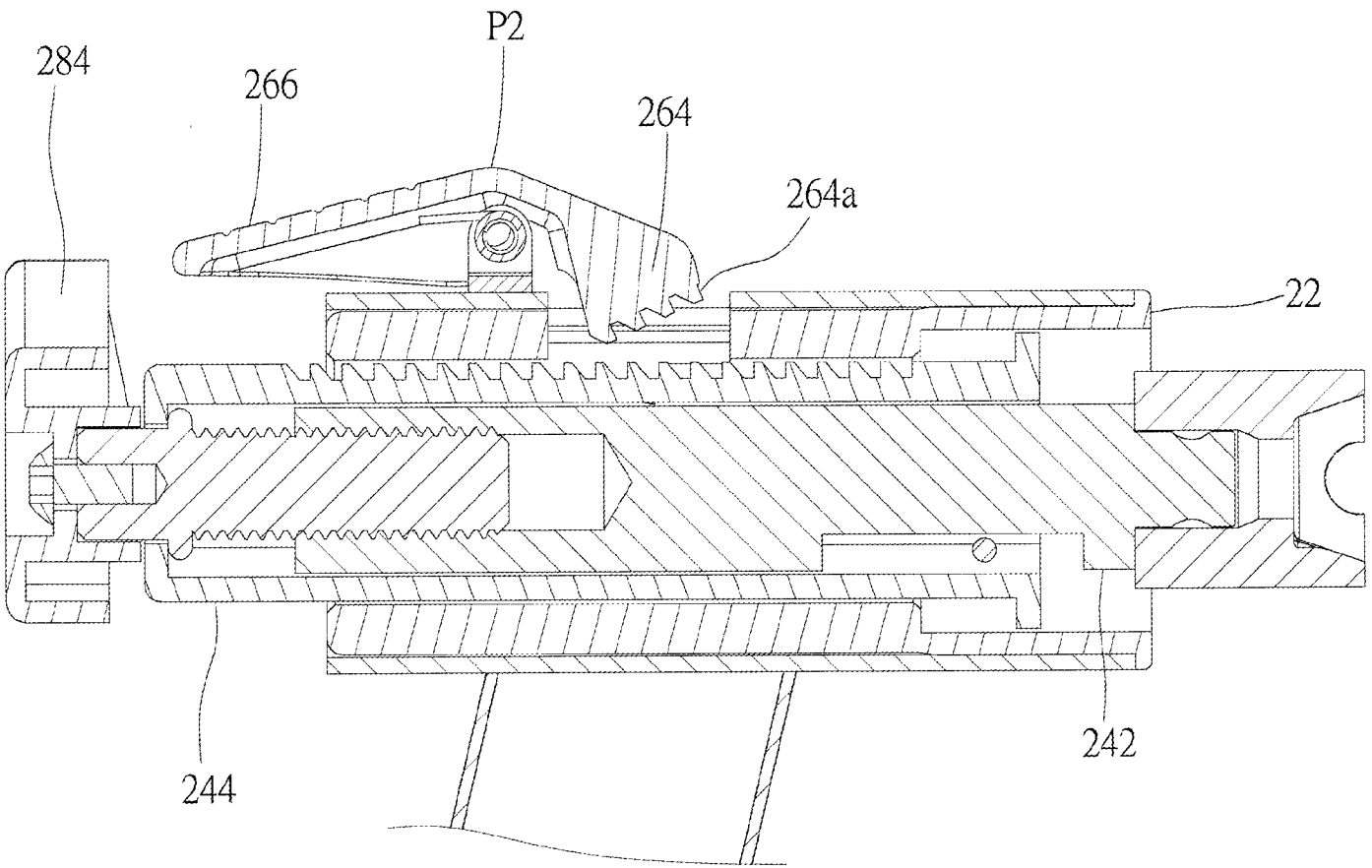
FIG. 5 is a sectional view of the first clamping unit of the preferred embodiment of the present invention, showing the operation member at the second position.

The operation member 26 is an elongated block, which has a pivot 262 near a central portion thereof going through the convex lug 12*c* of the frame 10 and the torsion spring 27. Therefore, the operation member 26 can be pivotally moved between a first position P1 (as shown in FIG. 4) and a second position P2 (as shown in FIG. 5). The operation member 26 has a contacting portion 264 and a pressing portion 266, which are respectively at opposite ends of the operation member 26. The operation member 26 can be moved toward the second position P2 by applying a force to the pressing portion 266. The contacting portion 264 goes through the perforation 12*b* of the first shaft tube 12 and the through hole 222 of the bushing 22. In more details, the contacting portion 264 includes teeth 264*a* which are meshed with the rack 244*a* of the sleeve 244 when the operation member 26 is at the first position P1. As a result, the abutting member 24 is not able to be moved relatively to the first shaft tube 12. On the other hand, if the pressing portion 266 of the operation member 26 is pressed, and the operation member 26 is moved to the second position P2, the teeth 264*a* are then no longer meshed with the rack 244*a*. At this time point, the abutting member 24 can be moved to a demanded position relative to the first shaft tube 12. Once the abutting member 24 arrives at the demanded position, and the pressing portion 266 is released, the torsion spring 27 will urge the operation member 26 back to the first position P1, and the teeth 264*a* are meshed with the rack 244*a* again. In this way, the abutting member 24 can be moved to the demanded position and then firmly fixed there without screwing any threaded rods as the conventional design.

Figure 6:
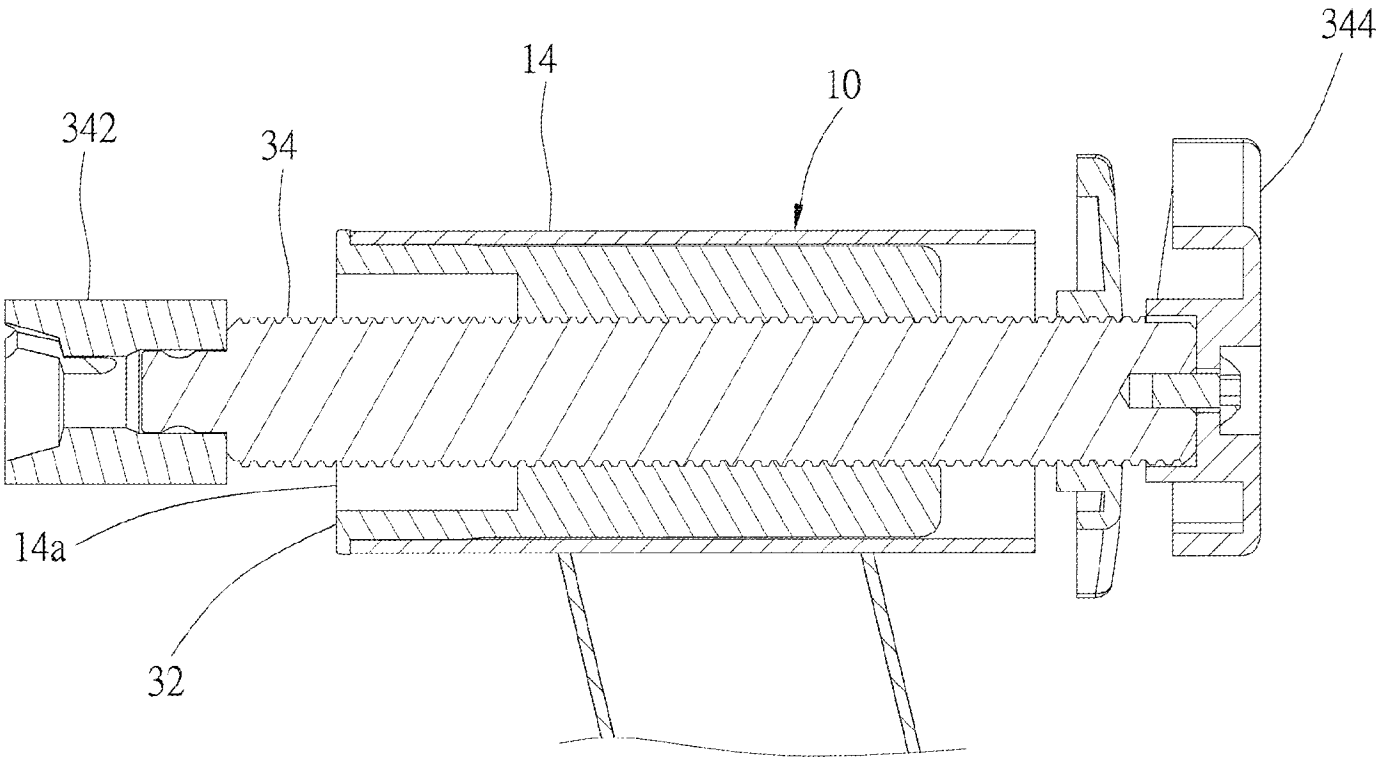
FIG. 6 is a sectional view of the second clamping unit of the preferred embodiment of the present invention.

As shown in FIG. 6, the second clamping unit 30 is provided in the axle bore 14*a* of the second shaft tube 14, and the second clamping unit 30 includes a bushing 32 and a threaded rod 34, wherein the bushing 32 is plugged in the axle bore 14*a*, and the threaded rod 34 is screwed in the bushing 32. The threaded rod 34 is longer than the second shaft tube 14, and therefore there is a part of the threaded rod 34 outside each end of the second shaft tube 14. More specifically, an abutting end 342 is provided at an end of the threaded rod 34 which towards the first clamping unit 20, while a head 344 is provided at an opposite end of the threaded rod 34. A position of the threaded rod 34 where it is in the axle bore 14*a* can be adjusted by rotating the head 344.

As shown in FIG. 7, the abutting end 242*d* of the first clamping unit 20 corresponds to the abutting end 342 of the second clamping unit 30 to clamp two ends of the axle 301 respectively. In more details, a user has to move the operation member 26 to the second position P2 first, and then adjust a clamp spacing between the first clamping unit 20 and the second clamping unit 30 by moving the abutting member 24 of the first clamping unit 20. After that, let the torsion spring 27 urge the operation member 26 back to the first position P1 to firmly fix the abutting member 24. In an embodiment, the operation member 26 can also be manually moved back to the first position P1 without the help of the torsion spring 27. Furthermore, the abutting shaft 242 which is screwed with the threaded rod 282 can be moved back and forth by rotating the adjusting member 28, and a distance between the abutting end 242*d* of the abutting shaft 242 and the head 284 of the adjusting member 28 can be fine-tuned in this way, which provides more flexibility. Compared to the conventional way of adjusting the clamp spacing by screwing threaded rods, the operation of the bicycle training stand 100 of the preferred embodiment provided in the present invention is quicker and easier. In addition, the firmness of the engagement between the bicycle training stand 100 and the bicycle wheel 300 is not affected.

It must be pointed out that the embodiments described above are only some preferred embodiments of the present invention. All equivalent structures which employ the concepts disclosed in this specification and the appended claims should fall within the scope of the present invention.

What is claimed is:

1. A bicycle training stand for engaging an axle of a bicycle wheel, comprising:

a frame having an axle bore and a perforation at at least an end thereof, wherein the perforation is communicated with the axle bore;

a first clamping unit and a second clamping unit provided on the frame to engage opposite ends of the axle;

wherein the first clamping unit comprises:

an abutting member fitted in the axle bore of the frame, wherein the abutting member is movable in an axial direction of the axle bore, and has an abutting end to contact the axle of the bicycle wheel;

an operation member pivotally provided on the frame, wherein the operation member is movable between a first position and a second position, and has a contacting portion which goes through the perforation; when the operation member is at the first position, the contacting portion presses the abutting member to confine a position of the abutting member; when the operation member is at the second position, the contacting portion has no contact with the abutting member;

wherein the abutting member of the first clamping unit has a rack thereon, and the contacting portion of the operation member has teeth to be meshed with the rack of the abutting member when the operation member is at the first position;

wherein the first clamping unit includes an adjusting member which has a threaded rod, and the abutting member includes an abutting shaft and a sleeve, wherein the sleeve is open at opposite ends thereof for receiving the abutting shaft therein; the rack is provided on an outer surface of the sleeve; the abutting shaft has a threaded hole for screwing in an end of the threaded rod of the adjusting member.

2. The bicycle training stand of claim 1, wherein the adjusting member further has a head connected to an end of the threaded rod; the threaded rod has a protrusion thereon, and the sleeve has an inner recess ring therein to correspond to the protrusion; the protrusion and the head are at opposite sides of the inner recess ring to confine a position of the adjusting member.

3. The bicycle training stand of claim 2, wherein the abutting shaft has a recess and two opposite abutting faces at opposite ends of the recess; the abutting member further has a pin inserted into the sleeve to be transversely received in the recess; a movable range of the abutting shaft is restricted by an abutment relation between the pin and the abutting faces.

4. The bicycle training stand of claim 1, wherein the first clamping unit further has a bushing plugged in the axle bore of the frame; the bushing has a through hole communicated with the perforation of the frame; the sleeve is received in the bushing, and is movable in the axial direction of the bushing; the teeth of the operation member are meshed with the rack of the sleeve through the perforation and the through hole.

5. The bicycle training stand of claim 1, wherein the frame has a convex lug provided at an end thereof, and the operation member further has a pressing portion for receiving a force to move the operation member to the second position from the first position; the operation member is pivotally connected to the convex lug with the contacting portion and the pressing portion at opposite sides of the convex lug.

6. The bicycle training stand of claim 5, further comprising a biasing member provided between the operation member and the convex lug, wherein the biasing member provides a pushing force to urge the operation member toward the first position.

* * * * *